US005913501A

United States Patent [19]

Heuss et al.

[11] Patent Number: 5,913,501

[45] Date of Patent: Jun. 22, 1999

[54] ADJUSTABLE STACKER BASE FOR RETAINING STACKED ARTICLES

[75] Inventors: David M Heuss, Lake Mills; Allen L. Mathews, New Berlin; Michael R Kulas, West Milwaukee, all of Wis.

[73] Assignee: Everbrite Inc., Greenfield, Wis.

[21] Appl. No.: 08/915,625

[22] Filed: Aug. 21, 1997

[51] Int. Cl.[6] ..... A47G 29/00

[52] U.S. Cl. ..... 248/346.07; 108/53.1; 108/54; 248/340.5

[58] Field of Search ..... 248/346.5, 346.01, 248/346.02, 346.03, 346.07; 108/53.1, 54.1

[56] References Cited

U.S. PATENT DOCUMENTS 2,942,827 6/1960 Edson ..... 108/54.1
4,382,733 5/1983 Rodgers ..... 248/346.02 X
5,546,871 8/1996 Chapman ..... 108/54.1
5,603,474 2/1997 Weber ..... 248/346.02 X

*Primary Examiner*—Ramon O. Ramirez
*Attorney, Agent, or Firm*—Ryan, Maki, Mann & Hohenfeldt

[57] ABSTRACT

A stacker base has L-shaped corner members arranged at the corners of a square or rectangle with connector members spanning between them and connected to the corner members to form an enclosure for the lower levels of a stack of articles. The corner and connector members are joined with various attachment devices such as screws or headed elements or hooks on the connector member ends for engaging and locking into a selected one of a row of slots in the corner members to thereby make stacker bases having article accommodating areas of different sizes.

5 Claims, 4 Drawing Sheets

ADJUSTABLE STACKER BASE FOR RETAINING STACKED ARTICLES

BACKGROUND OF THE INVENTION

The invention disclosed herein pertains to a base, called a stacker base, for keeping a stack of articles standing on a floor or other horizontal surface in orderly condition and for protecting the articles from water damage which might occur when a floor is being cleaned. The stacker base is also useful for protecting the articles from impact at near floor level.

The stacker base can be used for displaying articles such as stacks of six packs and twelve packs of canned or bottled beverages and a variety of other articles as well. The size or area encompassed by the new stacker base can be adjusted to accommodate an integral number of a plurality of articles so the lowermost layer of the articles will fit snugly within the confines of the area defined by the stacker base.

SUMMARY OF THE INVENTION

According to the invention, typically four corner members, similar to elbows with right angular branches are arranged at the corners of a rectangle or square. Also, connector members are provided for spanning the distance between corner members on a side of the base to provide for connecting the end regions of the connector members to the branches of opposite corner members. One embodiment of the invention uses screws as the fastener means for engaging the connector members with the corner members. Another embodiment of the stacker base is characterized by the speed and simplicity by which the base can be assembled where the attachment means constitute hooks that engage in selected ones of slots that are provided in both branches of the corner members.

Objectives and features achieved in the new stacker base design include a high impact and lightweight plastic member base which is adjustable to accommodate stacks of various sizes of articles. The stacker base is further notable for its ease of assembly and ease of adjustment to create walls around rectangular or square spaces. Another merit of the new stacker base is that, because of the ease of which the bases can be assembled, members comprising the base can be shipped unassembled so that huge volumes can be shipped within a small space.

How the foregoing objectives and features of the new stacker base are achieved and implemented, will appear in the ensuing more detailed description of a preferred embodiment of the invention which will now be set forth in reference to the accompanying drawings.

DESCRIPTION OF A PREFERRED EMBODIMENT

Figure 1:
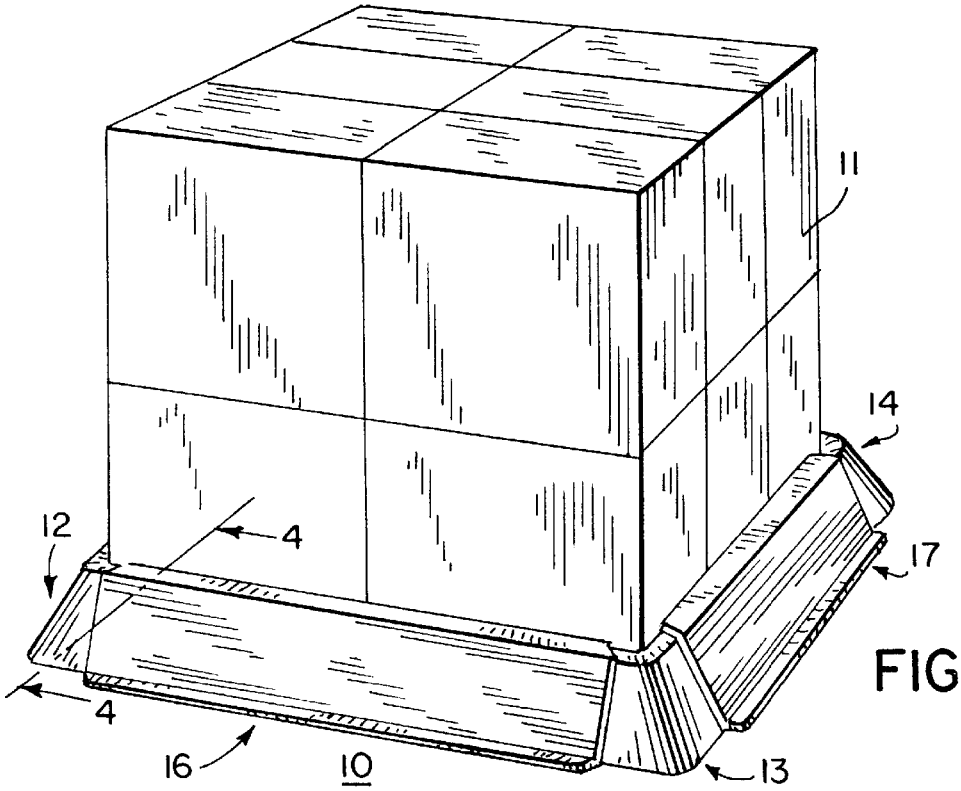
FIG. 1 is a front elevational perspective view of a stacker base whose corner members and connector members are adjusted relative to each other to provide a confined rectangular space with a base which has a stack of articles fitting snugly within it.
Figure 2:
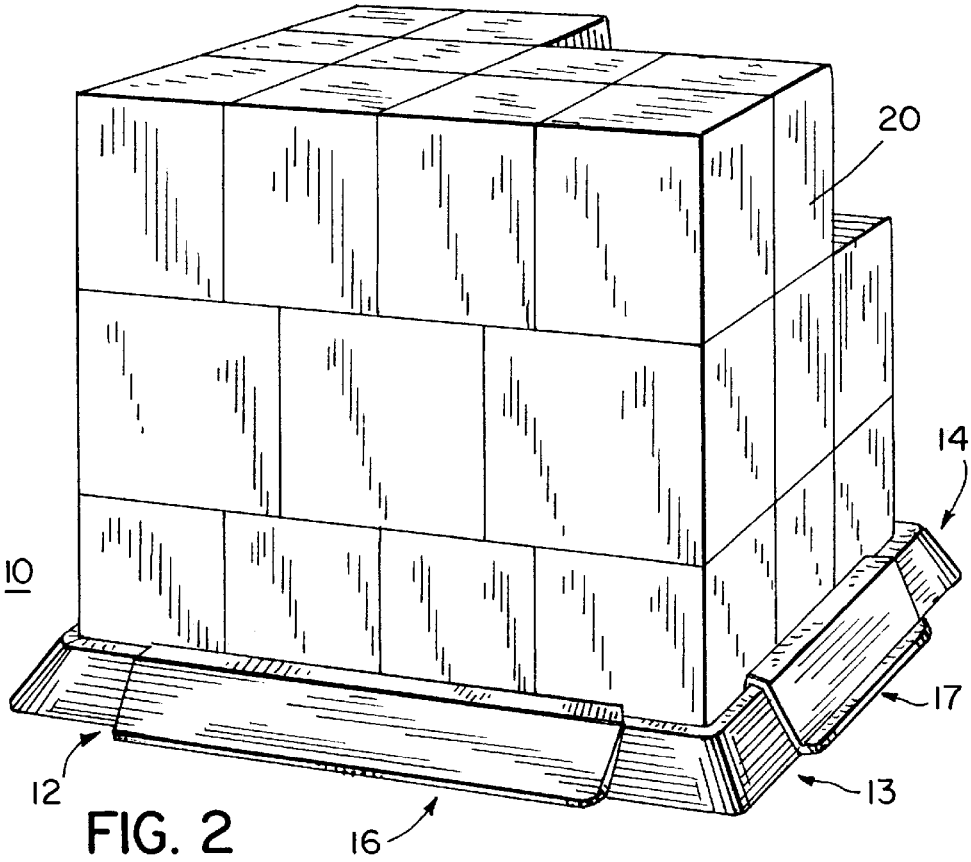
FIG. 2 is a front elevational perspective view of a stack of articles which differ in dimensions from the articles in preceding FIG. 1 and which are accommodated in a base using the same set of connector and corner members as in the preceding FIGURES.

In FIG. 1, an assembled stacker base is identified generally by the numeral 10. The stacker base is retaining several articles such as the one marked 11. These articles might be containers for six or 12 bottles or cans of a beverage, for example. Three of the four corner members 12, 13 and 14 which comprise the stacker base are visible in FIG. 1. Two of the connector members 16 and 17 of the four which comprise a stacker base are also visible in FIG. 1. In FIG. 2, the stacker base 10 is composed of the same members as in FIG. 1. The corner members, including members 12, 13 and 14, are identical to those used in FIG. 1 but they are separated from each other by a greater distance than they are in FIG. 1 to accommodate a stack of articles that requires more floor space than the stack of articles in FIG. 1.

Thus, although there is a greater distance between the corner members, they can be connected with connector members 16 and 17, for example, which have the same length as similarly-numbered connector members 16 and 17 in FIG. 1. The manner in which the stacker bases 10 are adjusted to accommodate stacks of articles that have various lengths and widths will now be discussed in reference to FIG. 3. First of all, note how the corner members, such as typical member 15, are constructed. Typical corner member 15 has two branches 21 and 22 joined at a right angle, and is preferably formed as a single piece of a rigid plastic such as polypigmented high-impact styrene although other high-impact plastics could also be used. The corner and connector members are vacuum formed in an actual embodiment. Typical corner member 15 is comprised of flat floor bearing extensions 25 and 26 with unitary walls 27 and 28 extending vertically upwardly therefrom. Walls 27 and 28 terminate in cap walls 29 and 30 that are unitary with downwardly angulated stiffener wall members 31 and 32 whose lower edges bear on the floor on which the stacker base is positioned to impart greater stability to the base. In addition, the lower edges of the vertically angulated wall members, such as the one marked 33, engage a flat floor with some sealing effect so that water used to mop the floor is inhibited from flowing under the stacker members. Part of the load force of a stack of articles is impressed on floor bearing extensions 25 and 26 to augment the structural integrity of the stacker base. Typical corner member 15 branches 21 and 22 have a row of spaced apart holes such as those marked 34 and 35. As will be explained momentarily, leaded fastener elements 36 and 37 are used to join the connector members, such as the one marked 19, to the corner members 12 and 15. The head and staked shank of a fastener is shown in FIG. 4.

Note that the typical walls 27, and 31 and cap 29 of the corner members define a truncated triangular configuration 37.

A connector member such as typical connector member 19 will now be described. The connector member is also preferably made by vacuum forming pigmented high-impact styrene resin. Connector member 19 comprises a flat laterally-extending bearing member 40, an angulated wall 41, a cap wall 42, another downwardly directed angulated wall 43 and a flat foot 34. The walls 41 and 43 of connector member 19, together with cap 42, define a truncated triangular channel 45 interiorly of connector member 19. Channel 45 is complementary in shape to the truncated triangular external shape defined by the wall 27, cap 29 and wall 31 of the corner member 15. The interior channel 45 defined by the walls and cap of connector member 19 provide for fitting the connector member snugly onto the truncated triangular shape defined by the wall 27, cap 29 and wall 31 of the typical corner member 15.

Connector member 19 has in its wall 41 a pair of holes 46 and 47. Connector member 19 can be superposed on a complementarily shaped pair of corner members, such as corner members 12 and 15 with the holes 46 and 47 lined up with selected holes such as hole 34 in the branches of corner members 12 and 15. A selected one of the holes 34 in the row of holes in a corner member, is aligned with holes 46 and 47 in respective opposite corner members as the shank of a fastener 36 can be inserted through the aligned holes to interconnect the corner members and the connector member. It will be evident that any pair of corner members, such as the pair composed of members 12 and 15, can be rigidly connected to each other with a space between their coplanar branches by whatever hole in the row of holes 34 is selected for insertion of a fastener 36 through it and a hole 46 and 47. The fastener could also be a threaded screw. The size of the area defined by the four corner members and the connector members depends upon which of the holes 34, for example, in the corner members is to receive the plug or screw or fastener 36. It will be evident that rectangular and square areas of various sizes can be created or defined by appropriate selection of the hole 34 which brings about the length of the side of the interior of the stacker base that is desired to accommodate articles of a particular size.

FIG. 4, which is a section taken along the line 4—4 in FIG. 1, illustrates how snugly a corner member, such as the one marked 12, can register in the complementarily-shaped connector member 16 which fits on the corner member 12. The tight fit between the corner members and connector members enhances the stiffness or rigidity of the assembled stacker base.

Figure 3:
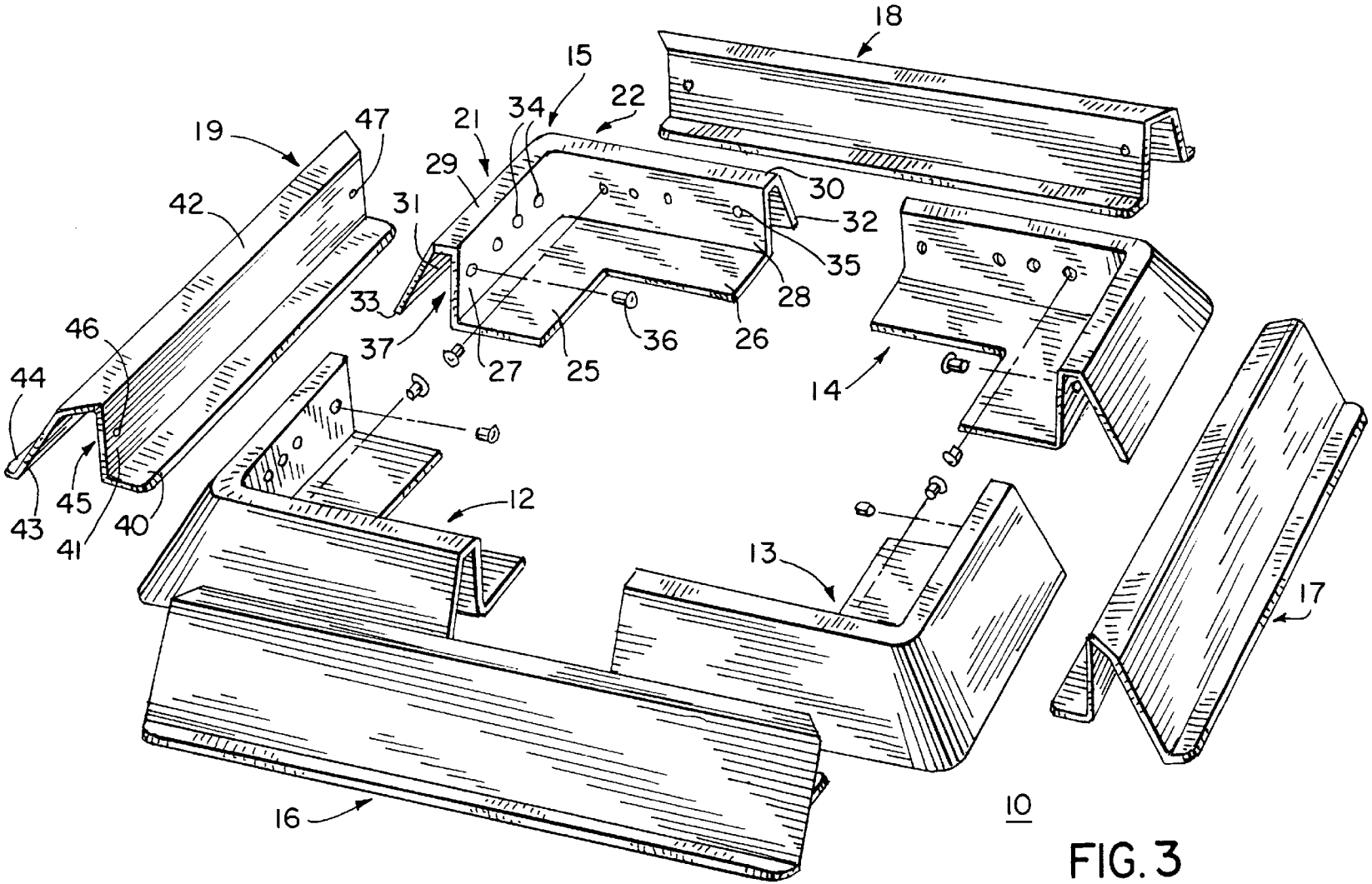
FIG. 3 is an exploded plan perspective view of the four corner pieces and four connector pieces arranged for being assembled to form a rigid base using insert elements that are pushed through holes in the corner members.
Figure 4:
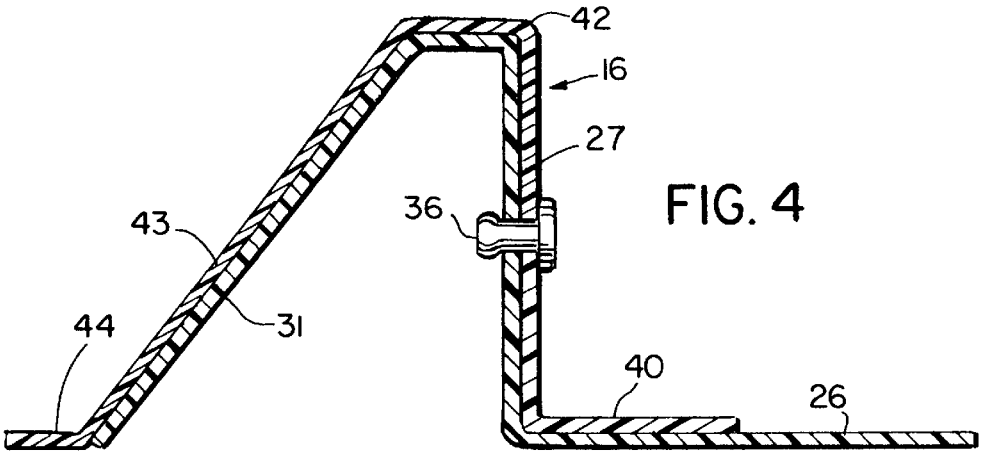
FIG. 4 is a vertical sectional view of a connector member assembled to a part of an underlying corner member with push-through elements, the section being taken on a line corresponding to the line 4—4 in FIG. 1.
Figure 5:
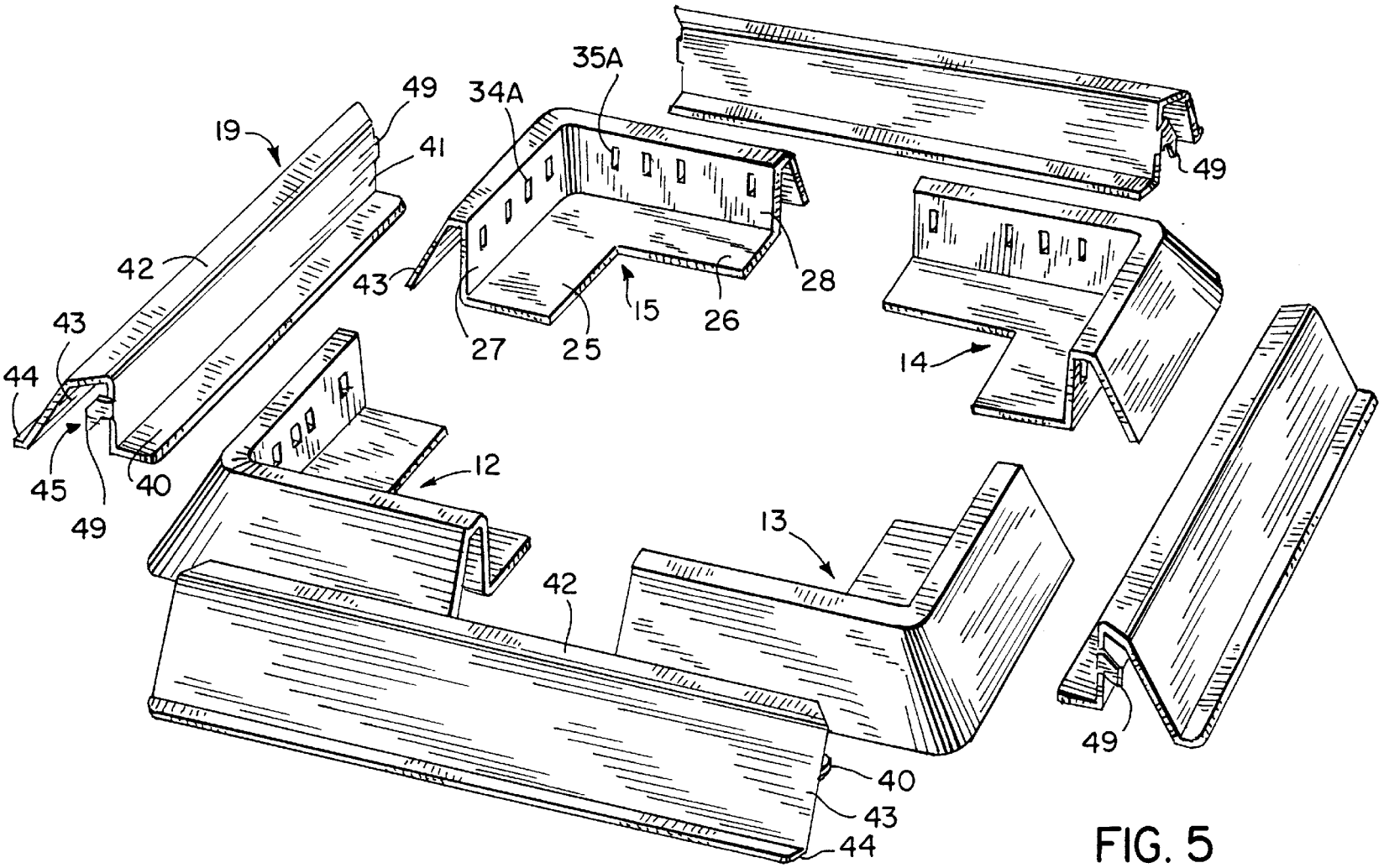
FIG. 5 is an exploded perspective view of the components of a stacker base, similar to FIG. 1 except that the connector members are connected to the corner members with integrally molded hooks on the ends of the connector for engaging a selected one of a plurality of slots in the branches of each of two corner members to obtain a rigid stacker base assembly.

Attention is now invited to FIG. 5 where the base differs from FIG. 3 only in respect of the way in which the corner members and connector members are joined with each other. In the FIG. 5 embodiment, walls 27 and 28 of the branches 21 and 22 of typical corner member 15 are provided with a row of slots 34A and 35A. Both ends of typical connector member wall 41 of a typical connector member 19 have hook tabs 49 formed integrally with them. Thus, while a connector member, such as member 19, is being pushed down onto the complementarily-shaped leg of a corner member, the hook tab 49 on each end of connector member are urged into a slot 34 which is followed by pressing the connector member down a little more until its flat, laterally-extending part 40 comes into contact with extension 25 on a corner member.

Figure 6:
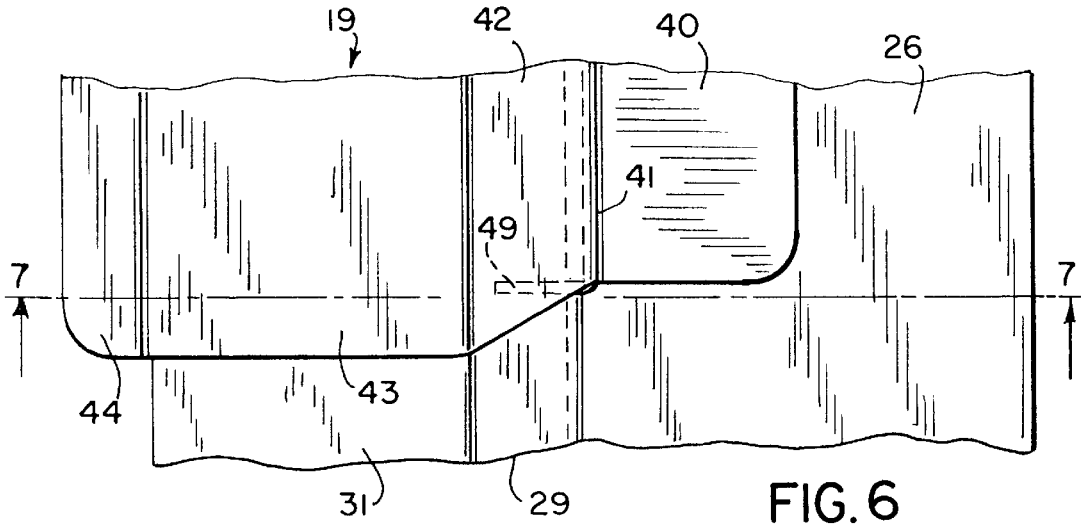
FIG. 6 is a top plan fragmentary view of the end of one of the connector members overlying and connected to a corner member.

FIG. 6 shows a fragmentary top plan view of one of the connector members 19 registered on a corner member 15, for example.

Figure 7:
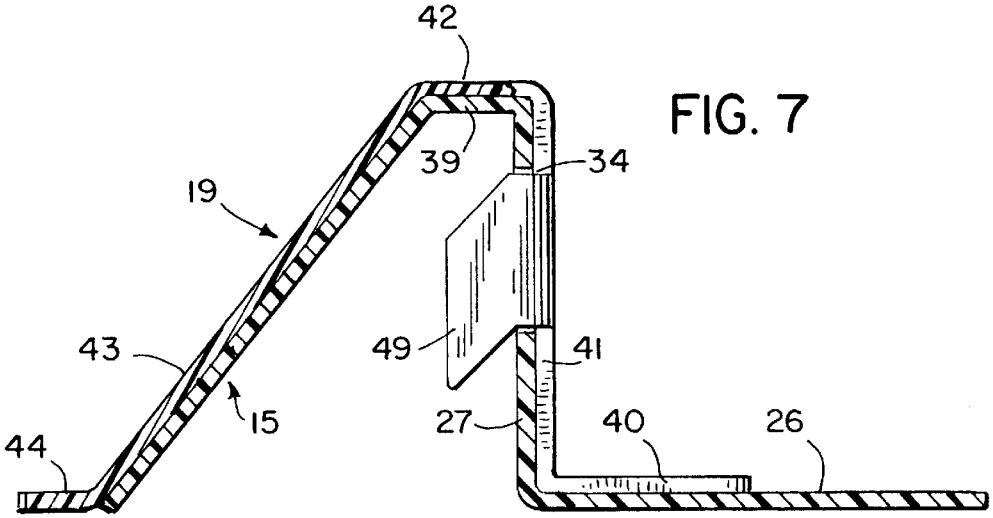
FIG. 7 is a vertical section taken on a line corresponding to the line 7—7 in FIG. 6.

FIG. 7 shows a typical connector member 19 superimposed on or registered on a corner member such as the one marked 15. Here one may note that the hook 49 has suitably beveled upper and lower edges to provide for the hook 49 to pass through a selected one of the slots 34 in the wall 27 of a branch of a corner member, for example.

We claim:

1. A stacker base adapted for standing on a surface to define the boundaries of a square or rectangular area for stacking a plurality of articles, the stacker base including a plurality of corner members for establishing the corners of a square or rectangular area, each of said corner members comprising branches that are joined with each other and extend from each other at a substantial right angle to provide for the branches of a corner member at one corner of a square or rectangular area being arranged in alignment with branches of two other corner members respectively, said branches having external surfaces defining a predetermined external shape, a plurality of elongated connector members having opposite end portions in which there is a recess having surfaces defining an internal shape that is complementary to the external shape of said branches of the corner members to provide for each end portion on a connector member to register on both of the branches on corner members which risers are in alignment, and means for engaging said opposite end portions of a connector member to said branches of corner members at selected places to provide for varying the size of said area.

2. A stacker base according to claim 1 wherein said means for engaging said opposite end portions of connector members to the branches of said corner members comprises having a row of holes extending along the branches, respectively, and at least one hole in opposite end portions of said connector members, and a headed attachment element having a shank for being inserted through a hole in an end portion of the connector member and through a selected one of said row of holes in a branch of a corner member.

3. A stacker base according to claim 1, wherein said means for engaging said opposite end portions of a connector member to branches of said corner members comprises having a row of slots extending along the branches, respectively, and hook tabs extending from the end portions of said connector members, said hook tabs being adapted for passing into a selected one of said slots and hooking onto a branch of a corner member.

4. A stacker base according to claim 1 wherein:

said elongated connector members are comprised of a pair of walls that are spaced apart and joined in parallel with each other and are coextensive in length and terminate in said end portions, said spaced apart walls are arranged to define a said recess having the configuration of a truncated triangle, said branches of said corner members are comprised of a pair of walls that are spaced apart, said walls of the corner members being arranged to define an exterior configuration that is complementary in shape to said recess in said connector members.

5. A stacker base according to claim 4 wherein:

one in each pair of said walls comprising a branch of a corner member extends vertically upwardly from a lower extremity of said one wall contiguous with a surface on which said corner member would stand and the other of said walls in the same pair is disposed at an angle relative to vertical, and there are flat plate members extending integrally from said lower extremity of the vertical walls of each of the pair of walls comprising a branch, the plate members extending horizontally over part of the article stacking area defined by the stacker base, said means for engaging said opposite end portions of said connector members to said branches comprises a row of slots in said vertical walls of a corner member and a tab hook projecting from each end portion of the connector members for a tab hook at one end portion of a connector member to register in one of said slots in the row of slots in a vertical wall comprising a branch of a first corner member and for the tab hook at said opposite end portion of said connector member to register in one of said slots in a vertical wall comprising a branch of a second corner member to hook a connector member adjustably to the branches of respective corner members.

* * * * *